US006065652A

United States Patent [19]

Dooling-Sherman

[11] Patent Number: 6,065,652

[45] Date of Patent: May 23, 2000

[54] ADJUSTABLE CLOTHING HANGER

[75] Inventor: Debra Dooling-Sherman, Oakland, Calif.

[73] Assignee: Ada Rose, Inc., Oakland, Calif.

[21] Appl. No.: 09/289,998

[22] Filed: Apr. 12, 1999

[51] Int. Cl.[7] ..... A47G 25/48

[52] U.S. Cl. ..... 223/93; 223/91; 223/90

[58] Field of Search ..... 223/90, 91, 93, 223/96, 85, 88

[56] References Cited

U.S. PATENT DOCUMENTS

| | | | |
|---|---|---|---|
| D. 396,150 | 7/1998 | Dooling | D6/318 |
| 1,530,857 | 3/1925 | Settle . | |
| 2,872,089 | 2/1959 | Shrom | 223/93 |
| 3,067,917 | 12/1962 | Reller et al. | 223/93 |
| 3,093,276 | 6/1963 | Volker | 223/93 |
| 3,140,024 | 7/1964 | Burns et al. | 223/93 |
| 3,209,966 | 10/1965 | Wach | 223/93 |
| 4,274,564 | 6/1981 | Warmath | 223/93 |
| 4,717,053 | 1/1988 | Wang | 223/94 |
| 4,884,727 | 12/1989 | Blanchard | 223/93 |
| 4,895,283 | 1/1990 | Evangelist et al. | 223/94 |
| 4,905,877 | 3/1990 | Gatling | 223/90 |
| 5,397,038 | 3/1995 | Hunt | 223/95 |
| 5,957,345 | 9/1999 | Petrou et al. | 223/96 |

*Primary Examiner*—Bibhu Mohanty
*Attorney, Agent, or Firm*—Hamilton, Brook, Smith & Reynolds, P.C.

[57] ABSTRACT

A garment hanger having arms, each of which has a hollow interior and an upper surface. A clamp slides along the upper surface and between a plurality of discrete locations where the clamp and the arm grips the garment between them. A cam track inside the arm moves the clamp alternatively from open to clamping positions as it moves along the arm.

12 Claims, 6 Drawing Sheets

ADJUSTABLE CLOTHING HANGER

BACKGROUND OF THE INVENTION

This invention relates to hangers for clothing and more particularly to hangers for garments, such as women's dresses and the like, but not limited thereto. The conventional way for displaying for sale and/or transporting said garments is by supporting them on racks, some of which have rollers, some are stationary, as in stores, some are circular and others rectangular. A rack often holds as many as one-hundred garments. At the manufacturing level, these garments may be all of one size and style and thus capable of being hung on conventional, non-adjustable hangers, also of one size. However, at the retail level, rarely, if ever, are one-hundred of the same size and style garments displayed on one rack. Frequently, a few of the same style are on racks and may differ merely in size. In better shops, however, garments, such as dresses, of totally different sizes, styles and colors are displayed on the same rack or are frequently stored outside of the retail selling area and brought to the customer one by one.

Where dresses of different styles or sizes are displayed on the same rack, be it circular or linear, they are hung vertically, being supported on the arms of hangers. However, a dress having relatively wide shoulders can easily fall off a hanger. Furthermore, one with a wide neck, and perhaps sleeves, can virtually obscure the next adjacent garment which may be sleeveless and supported by spaghetti straps. This is because a wider garment would extend outwardly further than a narrower or slimmer one on the same size hanger, thus obscuring the second or narrower garment.

It is one of the objectives of this invention to produce a hanger for garments which is of a single overall width but which can accommodate garments of different widths and with differing necklines.

Another objective of this invention is to produce a uniform hanger for such garments which is readily adjustable for different sizes of garments such that if a garment of one style is sold from the hanger, another of a completely different style can replace it.

The prior art is replete with adjustable hangers wherein the arms are extendable inwardly and outwardly to adjust for varying sizes of garments, but these hangers compound the problem of garment visibility when one supporting a relatively wide garment, e.g., one with wide shoulders, lies in front of one which is narrower. Furthermore, such hangers do not necessarily address the problem of garments slipping or falling off. Examples of such adjustable hangers are, as follows: U.S. Pat. Nos. 4,717,053, 4,905,877, and 5,397,038.

Yet another objective of this invention is to produce a hanger for garments which is of uniform size end to end but which can accommodate garments of varying sizes and shapes.

Yet another problem exists with dresses with very wide, scooped necklines and dresses of large sizes, e.g., sizes 20 and up. If such a dress, having a wide neckline and, perhaps, sleeves, is hung on a conventional hanger, the upper central portion or bodice of the dress would become crumpled if the dress had to be pushed to the center of the hanger in order to be hung. This may be partially alleviated by the so-called hidden hanging straps provided on some dresses, but the problem of the garment becoming crumpled is still not necessarily avoided.

Not the least of the problems relative to garments such as dresses and the like is the problem of the garment becoming soiled or wrinkled or damaged by either falling off the hanger or being inadvertently knocked off the hanger by a customer or salesperson. The problem has been addressed by putting indentations or other holding interstices on the top of conventional hangers, which is primarily restricted to garments that have hanging straps, either wearable spaghetti straps or the so-called hidden straps.

It is to these problems that this invention is directed.

SUMMARY OF THE INVENTION

The invention resides in a hanger for garments, such as women's dresses or the like. It has hanger arms that are joined together at a central location. A conventional hook for supporting the hanger on a bar or rail of a rack extends upwardly from the center of the hanger. The hanger arms extend outwardly and downwardly relative to each other in conventional fashion. They are of fixed length and are virtual mirror images of each other. They may be provided with hanging loops at their distal ends, also in conventional fashion.

The arms are made of molded plastic, in two halves which are secured together by adhesive or plastic welding. Each of the arms has an upper surface and a substantially hollow interior. A slot is formed in the surface and extends into the interior of the arm. A clamp is slidable along the upper surface and is moveable alternatively from an open position, to receive a portion of a garment to a closed clamping position relative to the upper surface. Clamping positions are spaced along the upper surface at discrete locations for clamping garments, such as women's dresses, on the neckline, the collar, or the shoulder, or on straps if the garment is so designed.

While the hanger has adjustable clamps to accommodate different sizes of garments, the arms of the hanger themselves are not extendable as frequently found in prior art hangers.

The clamp has a rider which extends through the slot into the interior of the arm. The rider is received in a guideway for movement lengthwise of the arm as the clamp, per se, moves lengthwise of the upper surface.

The guideway is a continuous cam track having alternating flat and inclined portions. The rider has at least one cam follower on it which rides in the track and which imparts pivotal motion to the clamp as it moves lengthwise of the cam track. The pivotal motion, in effect, is the motion of the clamp moving alternatively from between the open and clamping positions.

A spring member is also moveable in the cam track with the rider for urging the clamp firmly into the clamping position relative to the upper surface at each discrete location. The spring member has cam followers which ride in the cam track to move the spring member from a flat neutral position to a curved force-applying position pulling the clamp into clamping position relative to the upper surface.

Ribs are formed transversely of the upper surface of the arm at each of the discrete clamping locations and mating ribs are formed on the clamp such that when the clamp is at one of the discrete locations, the ribs come together to grip the garment firmly between them.

The above and other features of the invention including various and novel details of construction and combination of parts will now be more particularly described with reference to the accompanying drawings and pointed out in the claims. It will be understood that the particular hanger embodying the invention is shown by way of illustration only and not as a limitation of the invention. The principles and features of this invention may be employed in varied and numerous embodiments without departing from the scope of the invention.

DETAILED DESCRIPTION OF THE INVENTION

Figure 1:
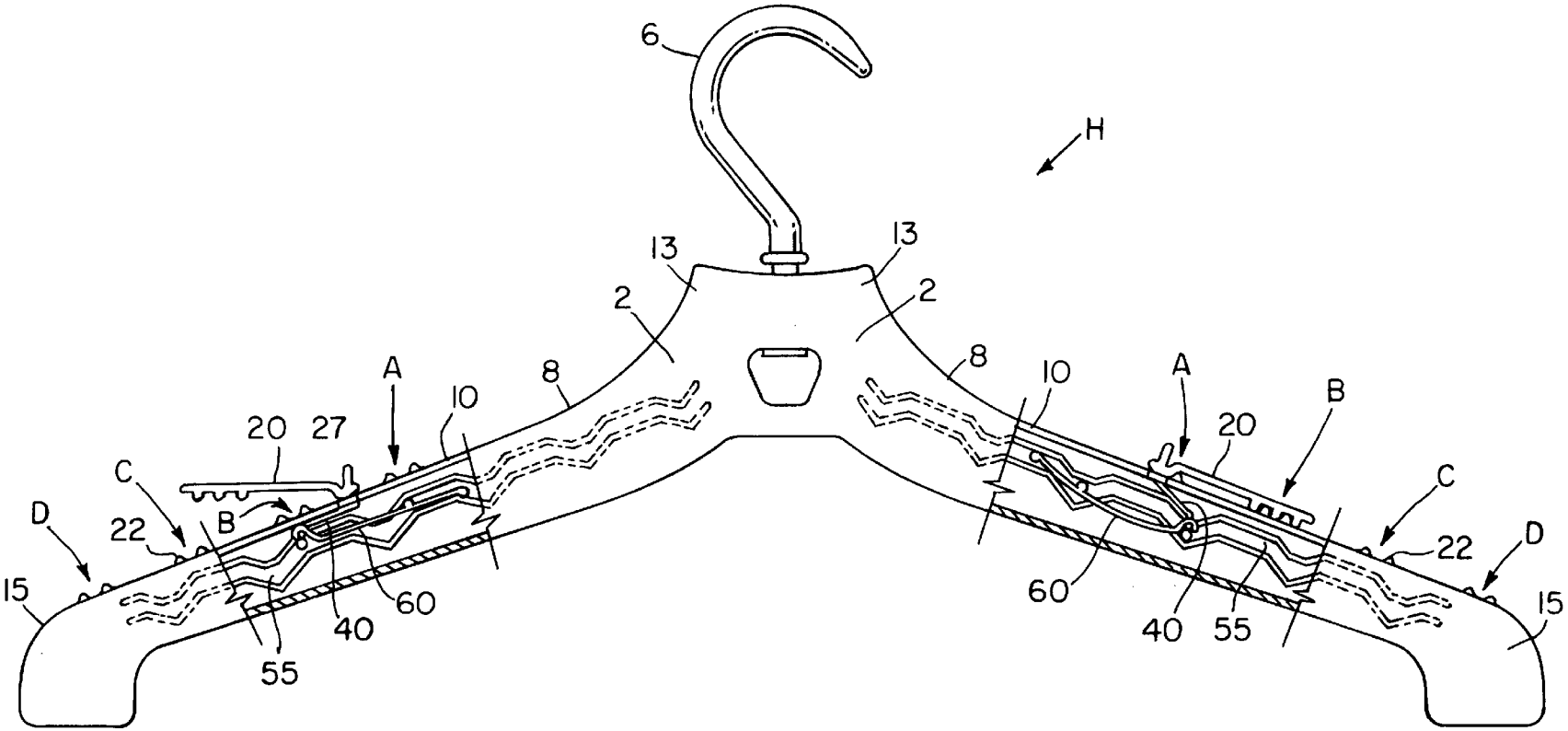
FIG. 1 is a front view with parts broken away and partly in section of a garment hanger embodying the invention, with the left clamp in open position and the right clamp in closed position.

Referring first to FIG. 1, the invention will be seen disclosed in a hanger generally indicated H. The hanger is designed particularly to accommodate delicate garments, such as women's dresses or the like, which have varying sizes of necklines. However, because of its versatility, it is not restricted to delicate garments, dresses, or even women's garments. The hanger includes a pair of hanger arms 2 extending outwardly and downwardly relative to each other. The arms 2 are essentially mirror images of each other, and, for the most part, the functional aspects of only one arm will be described. The arms 2 come together in conventional fashion at the center of the hanger H. Projecting upwardly from the center is a conventional pivotal hook 6 for engagement with a bar or rack (not seen), as, for example, in a dress shop or in a closet having the usual horizontal hanger bar.

Figure 3:
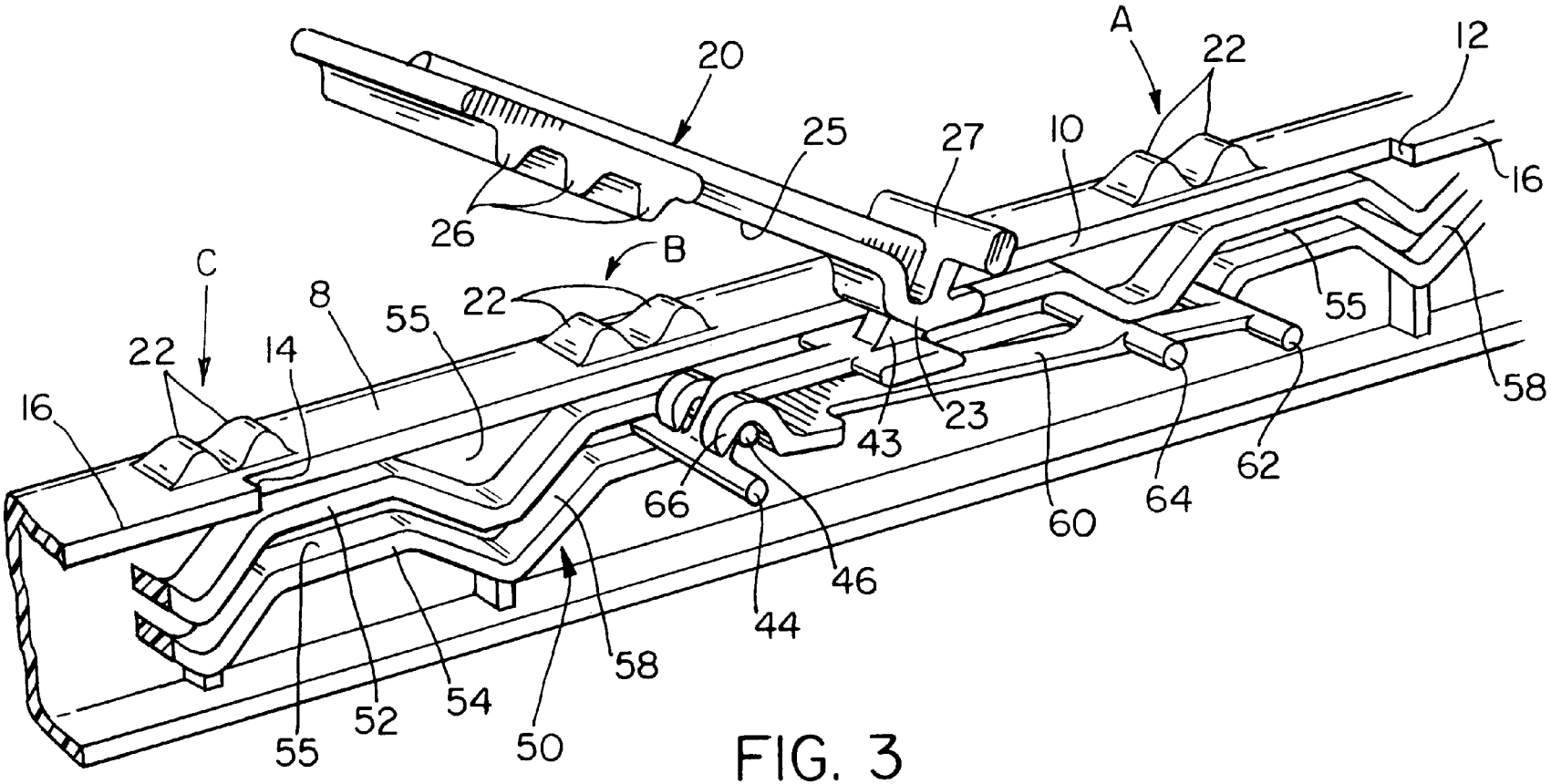
FIG. 3 is a detailed perspective view, on enlarged scale of the left arm of the hanger with the clamp in open position.

As will be seen in FIG. 3, each of the arms (only one being shown) has an upper surface 8 which extends from the front to the back of the arm. The front of the hanger is that which is visible in FIG. 1 and the back is parallel to the front, but not seen.

The hanger is molded in two pieces from plastic, as for example, a thermo plastic, such as polycarbonate or acetyl. The pivotal hook 6 may also be made of plastic or may be metal. The interior of the hanger is essentially hollow.

A slot 10 is formed in the upper surface 8 midway between the front and back of the arm. The slot is straight and provides access to the hollow interior of the arm. The slot extends from a wall 12 near the center of the hanger or proximal portion 13 of the arm to an opposite wall 14 near the free end 15 or distal portion of the arm.

Figure 4A:
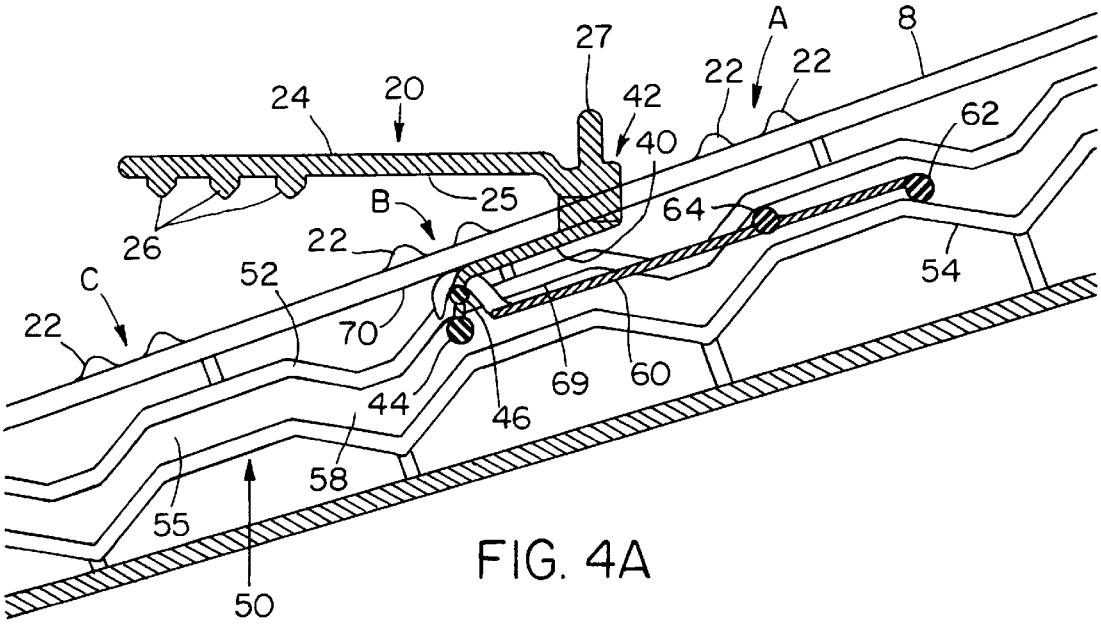
FIG. 4A is a sectional view showing the left clamp in the open position.
Figure 4B:
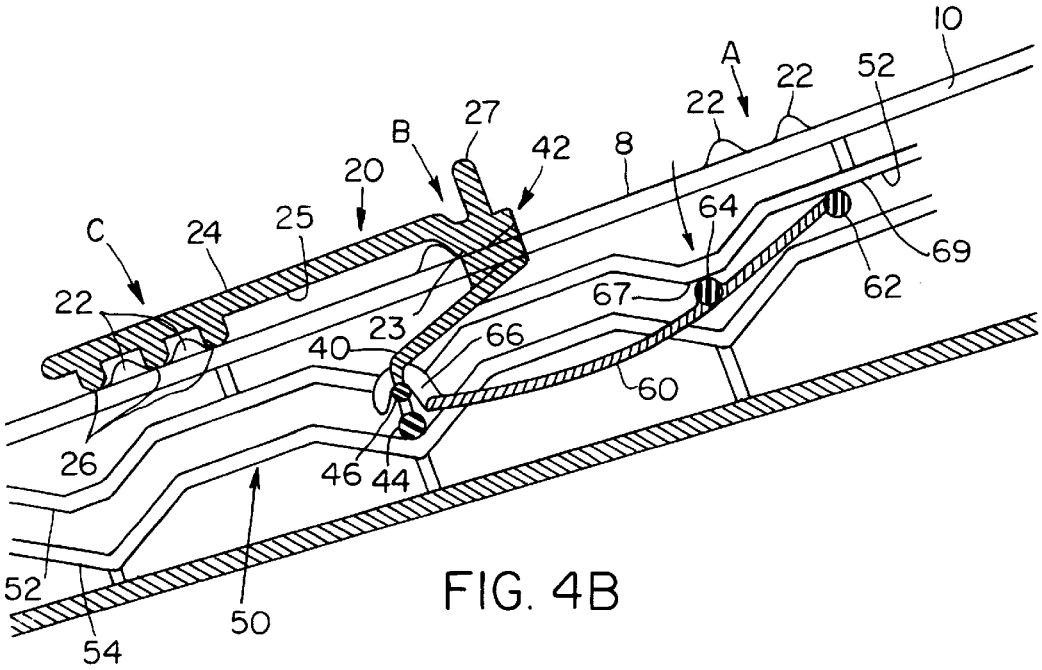
FIG. 4B is a view similar to FIG. 4A showing the left clamp in the closed or clamping position.

Whereas FIG. 1 is partially sectioned to show some of the interior of the hanger arm 2, FIGS. 3, 4A, and 4B have the front half of the hanger completely removed, showing the back half of the hanger only. The front and back portions or halves include both of the arms 2. The halves are joined along a center line 16, along which the slots 10 are formed. The hanger is assembled by cementing or plastic welding the front and back halves together along the center line 16. The slots 10 are thus formed in the upper surface 8 along the center line 16 extending from close to the proximal end of the arm at the center portion of the hanger to the distal ends 15. A clamp 20 is slidable along the upper surface 8. It is movable alternatively from an open position, as seen in FIGS. 3 and 4A, to a closed or clamping position, as seen in FIG. 4B. Similarly, in FIG. 1, the arm on the left shows the clamp 20 in open position and the arm on the right shows it in closed position.

In its open position, the clamp 20 or clamping member, as it is called, will receive a portion of the garment, as, for example, the neckline, collar or shoulder, and in the closed position, the garment is clamped firmly to the upper surface 8 of the arm. There are four discrete locations, A, B, C and D, along the upper surface 8 of the hanger arms. Only location A, C and D can be seen in FIG. 2A. At each of the discrete locations, there are sets of ribs, each rib being designated 22, which run transversely of the surface 8 and hence transversely of the center line 16 of the arms.

The clamp 20 comprises a flat bar 24 which has mating ribs 26 projecting from its lower surface. The ribs 26 also run transversely of the bar 24 and hence transversely of the slot 10 and the center line 16. The ribs 26 mesh with the ribs 22 on the hanger arm as best seen in FIG. 4B. A finger bar 27 extends upwardly of the bar 24 to assist in manually moving the clamp along the arm.

Figure 2A:
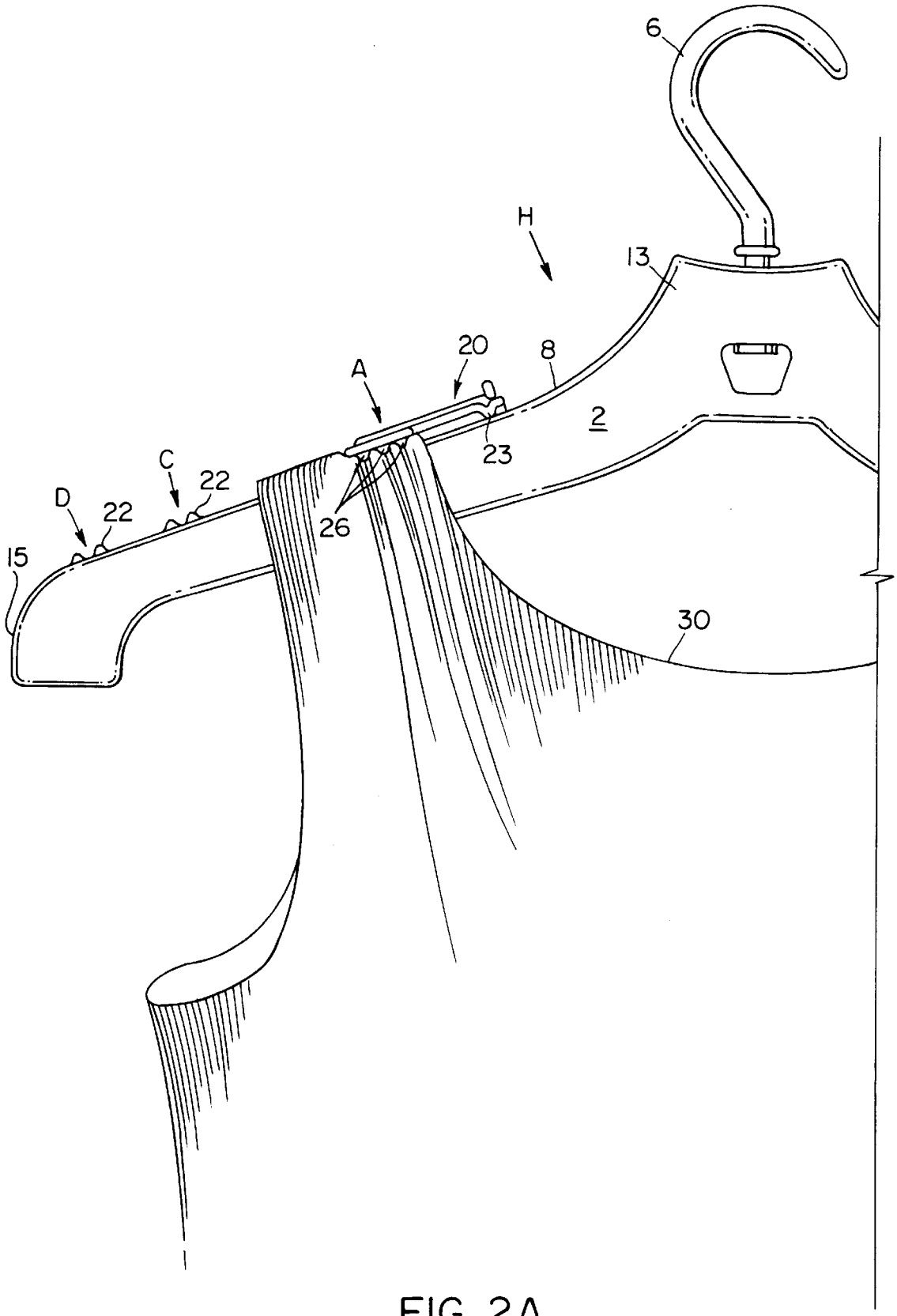
FIG. 2A is a front view, on a slightly enlarged scale, of the hanger supporting a woman's dress having a relatively high, narrow neckline.
Figure 2B:
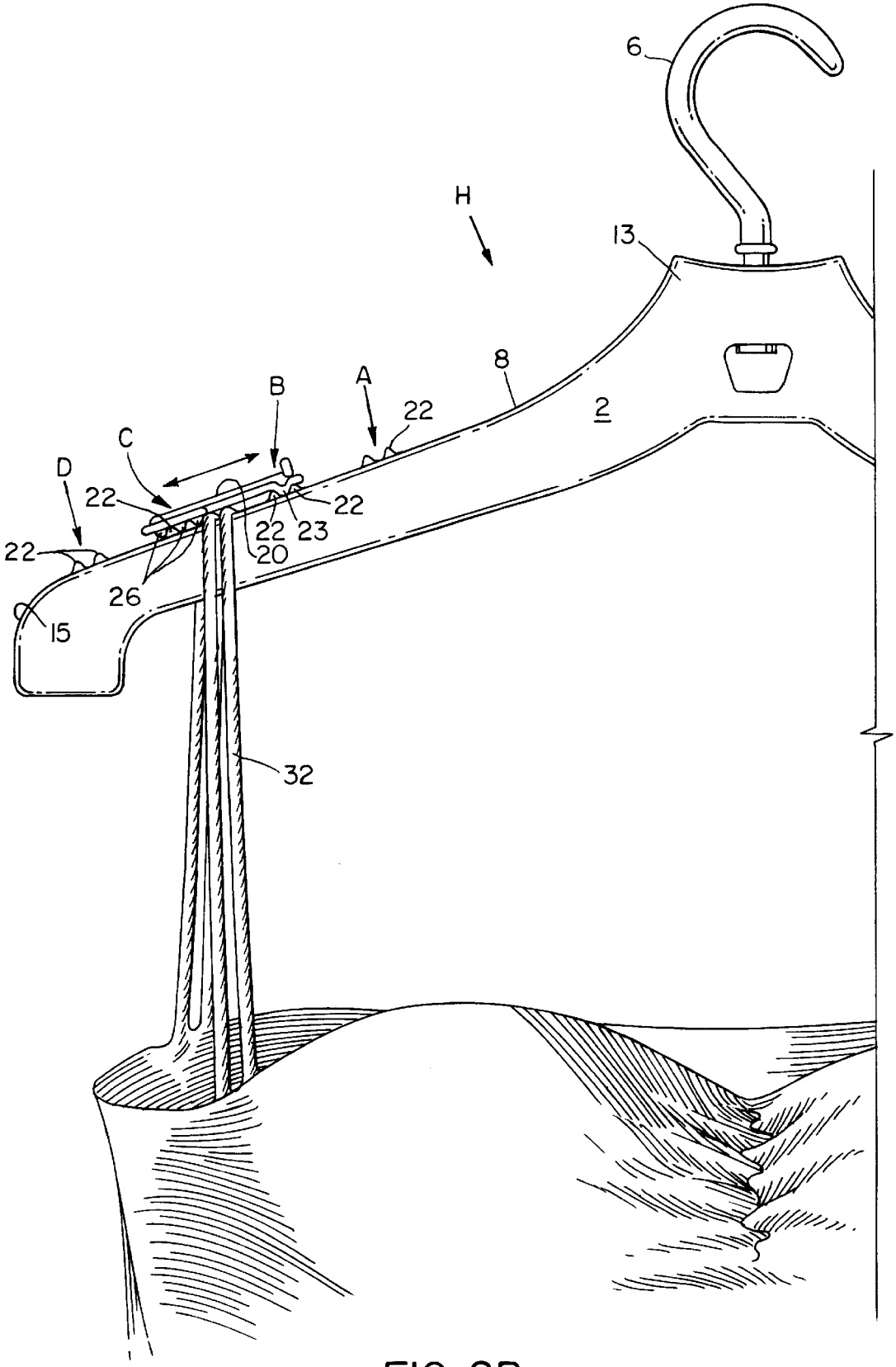
FIG. 2B is a view similar to FIG. 2A of the hanger supporting a woman's dress having so-called spaghetti straps.
Figure 2C:
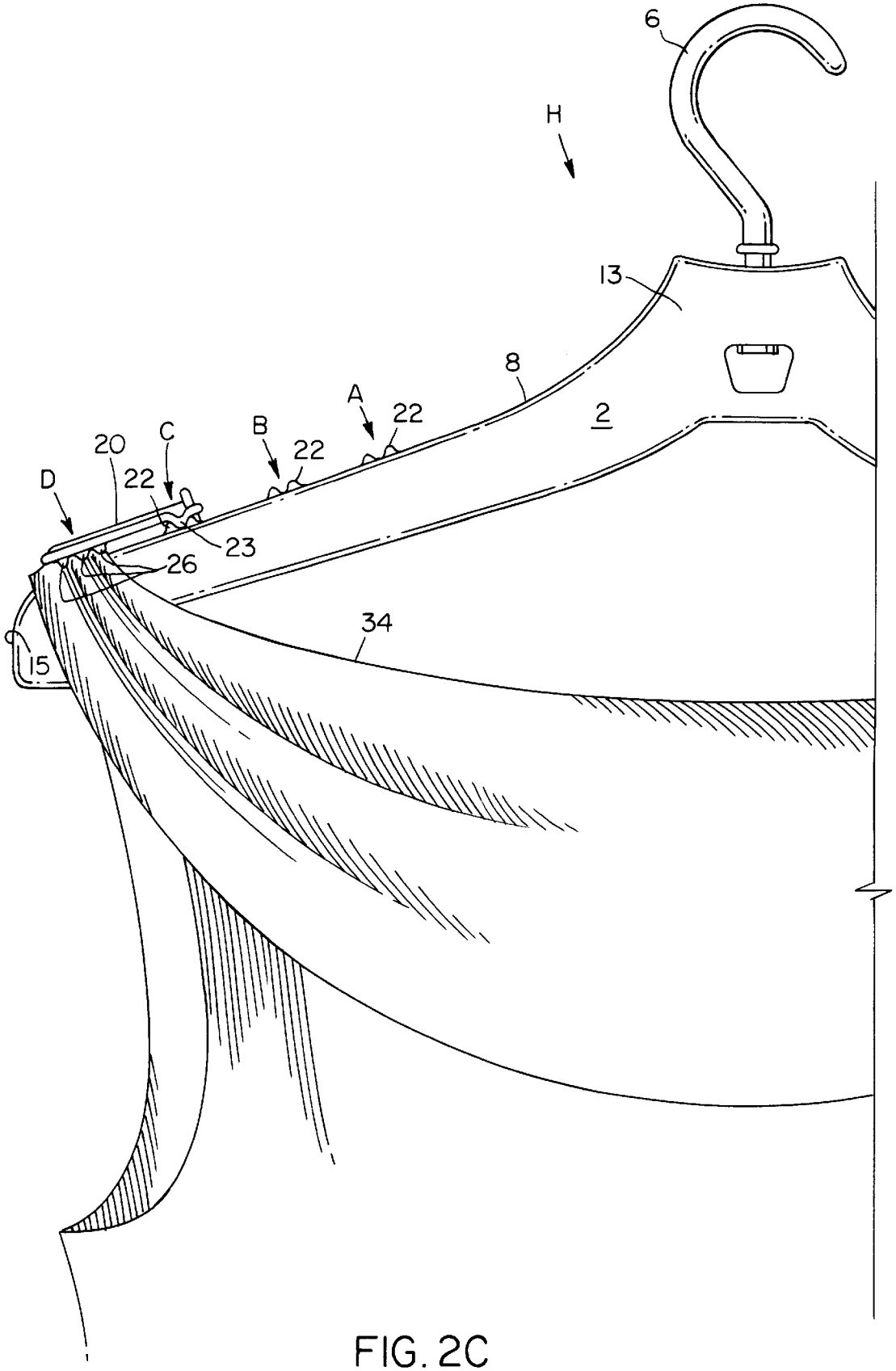
FIG. 2C is a view similar to FIG. 2A of the hanger supporting a woman's dress having a relatively wide, scooped neckline.

Referring next, seriatim, to FIGS. 2A, 2B and 2C, FIG. 2A shows a woman's dress having a relatively narrow, curved neckline 30 with one of its shoulders clamped on the left hanger arm 2. The dress material is laid on the ribs 22 (not visible) and the clamp 20 is moved (as will be described hereinafter) such that its ribs 26 will mesh only with the ribs 22 while engaging the outside portion of the garment. This is shown occurring at discrete location A. Depending upon the width of the shoulder portion of the garment, some of it may overlie the ribs at clamping position B, as in FIG. 2A, or even discrete clamping position C or D if the garment were to have, for example, short sleeves.

Referring next to FIG. 2B, a different dress, one having one or more spaghetti straps 32 at each shoulder, will be seen hanging from the left arm 2 of the hanger. In this case, the straps are located between discrete positions B and C. When the clamp 20 is in the closed or clamping position, its ribs 26 directly engage the ribs 22, clamping at location C, with the straps being restricted from falling off by this closed relationship. It is possible, however, to place one or both of the straps between the ribs 22 on the arm, allowing the ribs 26 on the clamp to capture the straps between them.

Referring next to FIG. 2C, a dress having a relatively wide boat neck 34 will be seen clamped in location or position D with the ribs 26 of the clamp engaging the outside of the dress, with the inside lying on top of the ribs 22 (not seen) of position D, much in the same fashion as the garment in FIG. 2A. This keeps the dress from sliding off the hanger. It should be noted that when the clamp 20 is functioning at discrete position D, a ridge 23 of the clamp is located in engagement with the ribs 22 of discrete position C, as will be described hereinafter.

The operating mechanism for the clamp will now be described particularly with reference to FIGS. 4A and 4B. The clamp 20 is a one-piece, flexible member with a low coefficient of friction and which may be made of NYLON, DELRIN or the like. It includes an integral lower member or rider 40, forming an acute angle with an upper flat bar 24 from which the ribs 26 project. The ribs extend transversely of the bottom side 25 of the bar 20. The rider 40 is joined to the clamp 20 at a junction area, generally indicated 42. The rider has a portion 43 extending through the slot 10 into the hollow interior of the arm, where the rider 40 is located. The free end of the rider 40 mounts a transverse cam follower 44, and a second smaller transverse bar 46 is also located near the free end of the rider 40.

A guideway, generally indicated 50, is located in the interior of the arm and includes upper guide rail 52 and a lower guide portion 54. Together, they constitute a cam track 55 in which the cam follower 44 rides. Guide rails 52 and 54 project from the back wall 55 of one of the halves of the arm and guide rails 52 and 54 project from the opposite half of the track. When assembled, these guide rails 52 and 54 present a closed pathway or cam track. The cam track 55 includes alternating flat portions 56 and inclined portions 58.

A flexible spring 60 causes the clamp 20 to open and close. In its non-flexed state, it is a flat bar, best seen in FIG. 4A. The spring 60 includes a pair of cam followers 62 and 64 (FIG. 3), extending transversely of the spring member. The cam follower 62 is at one end of the spring 60, and at the opposite end are a pair of hooks 66. The cam followers 64 are intermediate the ends of the spring. When assembled, the hooks 66 engage over the bar or rod 46 and the cam follower 64 engages the lower side of the guide rail 52, as seen in FIGS. 4A and 4B. The cam follower 62 at the end of the spring member 60 engages both the lower side of the upper rail member 52, as seen in FIG. 4B, and the upper side of the rail member 54, as seen in FIG. 4A.

As the clamp 20 is moved lengthwise of the slot 10, the spring 60 pulls downwardly on the rider arm 40, as seen in FIG. 4B, to urge the clamp against the upper surface 8 of the arm, with its ribs 26 meshing with the ribs 22 on the arm. At this time, the cam follower 46 is at the bottom of one of the inclined portions 58 of the cam track 55, being urged downwardly by the now flexed spring 60 through engagement of the hooks 66 with the bar 46. At this time, the cam follower 64 is in engagement with the next adjacent flat surface 67 of the upper rail 52, and the endmost cam follower 62 is in engagement with the lower surface of the upper rail 52. The respective parts are now in the clamping position.

The respective positions of the spring 60 and clamp 20 in the open position will be seen in FIG. 4A and in FIG. 3. In the open position, the clamp 20 is pivoted on ridges on the upper surface 8 of the arm. This occurs when the follower 44 on the rider 40 is in engagement with the flat lower surface 69 of the upper rail 52. The upper surface of the rider 40 is then against the bottom surface 7 of the top or upper surface 8 of the arm. The clamp 20 has relatively little flexibility, and with the portion 24 and the rider 40 at acute angles with each other, the portion 24 of the clamp is in the open position away from the upper surface 8 of the arm. At this time, the cam follower 62 is against the surface of the rail 54.

As the arm is moved lengthwise of the slot 10 in the upper surface 8, clamp 20 will alternately move from the open position of FIG. 4A to the closed position of FIG. 4B, with the ribs 22 and 26 in mating relationship.

What is claimed is:

1. A hanger for garments such as women's dresses or the like comprising:

hanger arms extending outwardly and downwardly relative to each other;

each of said arms having an upper surface and a substantially hollow interior;

a slot formed in the upper surface and extending into the interior for providing access thereto;

a clamp slidable along the upper surface;

the clamp being moveable, alternatively, from an open position to receive a portion of a garment at the neckline, collar or shoulder, to a closed position to urge and hold the garment against the upper surface of the arm;

the clamp having a rider extending through the slot into the interior of the arm; and mechanism within the arm to shift the clamp alternatively between the open and closed positions as the clamp moves along the upper surface.

2. A hanger according to claim 1 wherein the mechanism within the arm for shifting the clamp is a guideway.

3. A hanger in accordance with claim 2 wherein the guideway is a continuous cam track having alternatively flat and inclined portions.

4. A hanger in accordance with claim 2 wherein there is a spring member moveable in the guideway with the rider for urging the clamp firmly into the closed position relative to the upper surface.

5. A hanger in accordance with claim 3 wherein the rider has a cam follower engagable with the cam track to shift the clamp, alternatively, toward the open and the closed positions as it moves along the upper surface.

6. A hanger in accordance with claim 4 wherein the spring member has cam follower means engagable in the cam track to flex the spring member to move the follower and cause the clamp to be forced into the closed position.

7. A hanger for garments such as women's dresses or the like comprising:

hanger arms joined together at a central location and extending outwardly and downwardly relative to each other, terminating in free ends;

each of said arms having an upper surface and a substantially hollow interior;

a slot formed in the upper surface and extending into the interior for providing access thereto;

and a clamp slidable along the surface toward and away from the free end;

a plurality of discrete locations on the upper surface;

the clamp being moveable from an open position to receive a portion of a garment at the neckline, collar or shoulder, to a closed position at a discrete location to grip the garment against the upper surface of the arm;

the clamp having a rider extending through the slot into the interior of the arm; and mechanism within the arm to shift the clamp, alternatively, between the open and closed positions at the discrete locations as the clamp moves along the upper surface.

8. A hanger in accordance with claim 7 wherein ribs are formed on the upper surface transversely of the slot and mating ribs are formed on the clamp to grip the garment between them when the clamp is in the closed position.

9. A hanger in accordance with claim 7 wherein the mechanism is a continuous cam track having alternating flat and inclined portions.

10. A hanger in accordance with claim 7 wherein the rider has a cam follower engagable with the cam track and rods to shift the clamp alternatively toward the open and the closed positions as it is moved lengthwise of the surface.

11. A hanger in accordance with claim 8 wherein there is a spring member moveable in the cam track with the rider for urging the clamp firmly into the closed position relative to the upper surface at each discrete location.

12. A hanger in accordance with claim 10 wherein the spring member has cam followers engagable in the cam track to flex the spring member to move the follower and cause the clamp to be forced into the closed position.

* * * * *